US007013620B2

(12) United States Patent
Hölzlwimmer et al.

(10) Patent No.: US 7,013,620 B2
(45) Date of Patent: Mar. 21, 2006

(54) PROCESS AND APPARATUS FOR THE COST-EFFECTIVE PACKAGING OF POLYSILICON FRAGMENTS

(75) Inventors: Rainer Hölzlwimmer, Neuötting (DE); Axel Frauenknecht, Burghausen (DE)

(73) Assignee: Wacker-Chemie GmbH, Munich (DE)

( * ) Notice: Subject to any disclaimer, the term of this patent is extended or adjusted under 35 U.S.C. 154(b) by 0 days.

(21) Appl. No.: 10/945,188

(22) Filed: Sep. 20, 2004

(65) Prior Publication Data

US 2005/0034430 A1 Feb. 17, 2005

Related U.S. Application Data

(62) Division of application No. 10/353,256, filed on Jan. 28, 2003, now abandoned.

(30) Foreign Application Priority Data

Feb. 1, 2002 (DE) ..... 102 04 176

(51) Int. Cl.
*B65B 1/04* (2006.01)

(52) U.S. Cl. ..... 53/449; 53/469

(58) Field of Classification Search ..... 53/449, 53/445, 170, 171, 511, 433, 425, 542, 502; 141/10, 83
See application file for complete search history.

(56) References Cited

U.S. PATENT DOCUMENTS

| | | | | |
|---|---|---|---|---|
| 2,659,521 A | | 11/1953 | Foster et al. | |
| 3,389,529 A | | 6/1968 | Allen et al. | |
| 4,681,228 A | * | 7/1987 | Kerry et al. | 53/449 |
| 4,691,866 A | * | 9/1987 | Belk | 241/5 |
| 4,813,205 A | * | 3/1989 | Mikata et al. | 53/449 |
| 4,928,474 A | * | 5/1990 | Schirmer | 53/449 |
| 5,122,262 A | | 6/1992 | Summers | |
| 5,855,232 A | | 1/1999 | Oda et al. | |
| 6,007,869 A | * | 12/1999 | Schreieder et al. | 427/213 |

FOREIGN PATENT DOCUMENTS

| | | |
|---|---|---|
| DE | 36 40520 | 6/1988 |
| DE | 3640520 | 6/1988 |
| DE | 9306944 | 8/1993 |
| EP | 0537988 | 10/1992 |
| EP | 0537988 | 10/1995 |
| GB | 906312 | 5/1961 |

OTHER PUBLICATIONS

English Derwent Abstract AN 1988-162350[24] corresp. to DE 3640520.
English Derwent Abstract corresponding to DE 9306944U1.
English De-went Abstract AN 1988-162350 [24] corresp to DE 3640520 A.
English Abstract corresponding to DE 9306944 U1.

* cited by examiner

*Primary Examiner*—John Sipos
(74) *Attorney, Agent, or Firm*—Collard & Roe, P.C.

(57) ABSTRACT

A process for the cost-effective packaging of high purity polysilicon fragments has the polysilicon fragments being packaged automatically.

1 Claim, 1 Drawing Sheet

PROCESS AND APPARATUS FOR THE COST-EFFECTIVE PACKAGING OF POLYSILICON FRAGMENTS

CROSS REFERENCE TO RELATED APPLICATIONS

Applicants claim priority under 35 U.S.C. 119 of German Patent application No. 102 04 176.8 filed Feb. 1, 2002. This Patent application is a division of and Applicants claim priority under 35 U.S.C. 120 of U.S. patent application Ser. No. 10/353,256 filed Jan. 28, 2003 now abandoned.

BACKGROUND OF THE INVENTION

1. Field of the Invention

The invention relates to a process and an apparatus for the cost-effective, low-contamination packaging of polysilicon fragments.

2. The Prior Art

Polysilicon fragments are, for example, deposited from trichlorosilane by means of the Siemens process and then comminuted in a contamination-free manner. They are generally used in the solar or semiconductor industry, for example for the production of solar cells or extremely pure silicon wafers. For these applications, polysilicon fragments which are contaminated as little as possible are desired. Therefore the material is packaged for the transport to the users. However, this packaging has hitherto been carried out manually, with a high level of contamination and with high expenditure on personnel.

SUMMARY OF THE INVENTION

It is an object of the present invention to provide a process which permits cost-effective, low-contamination packaging of high purity polysilicon fragments.

The object is achieved by a process wherein the polysilicon fragments are packaged automatically.

In principle, all the automatic packaging machines known in the prior art for fragmentary material are suitable as apparatus for carrying out the process.

The invention therefore also relates to the use of an automatic packaging machine for packaging high purity polysilicon fragments.

The use according to the invention of an automatic packaging machine permits, both cost-effectively and completely automatically, the portioning, filling and packaging of high purity polysilicon fragments.

The automatic packaging machine used is preferably an apparatus comprising

- a means of portioning the polysilicon fragments
- a filling device, comprising a plastic bag
- a welding device for the plastic bag filled with polysilicon fragments.

In order to avoid the risk of contamination of the polysilicon fragments, all the parts of the apparatus according to the invention that come into contact with the polysilicon fragments are particularly preferably sheathed with silicon or clad with a highly wear-resistant plastic. In addition, in order to minimize piercing of the packaging, it is particularly preferred to configure the apparatus according to the invention in such a way that the polysilicon fragments are packaged by means of two welded plastic bags.

Particularly preferably, therefore, a packaging machine according to the invention therefore again has a filling device after the welding device for the plastic bag filled with polysilicon fragments. This device comprises a plastic bag and a welding device for this plastic bag, which contains a plastic bag filled with polysilicon fragments.

An apparatus according to the invention preferably additionally also permits the fully automatic transport of the polysilicon fragments and therefore additionally comprises means for conveying the polysilicon fragments. This means for conveying includes a conveyor channel, a conveyor tube, a conveyor belt or a brush belt.

Means for portioning the polysilicon fragments are, for example, a time-controlled conveyor channel or determining the filling level of a storage container or a weighing device for the polysilicon fragments.

The filling device preferably forms the plastic bag from a preferably highly pure plastic film, for example by means of a filling and bag-forming tube.

In a particularly preferred embodiment, the apparatus additionally comprises an air extraction device (flowbox) fitted above the filling device for the polysilicon and the welding device, which prevents the polysilicon fragments from being contaminated by particles.

BRIEF DESCRIPTION OF THE DRAWINGS

Other objects and features of the present invention will become apparent from the following detailed description considered in connection with the accompanying drawing which disclose several embodiments of the present invention. It should be understood, however, that the drawing is designed for the purpose of illustration only and not as a definition of the limits of the invention, in which.

DETAILED DESCRIPTION OF PREFERRED EMBODIMENTS

Figure 1:
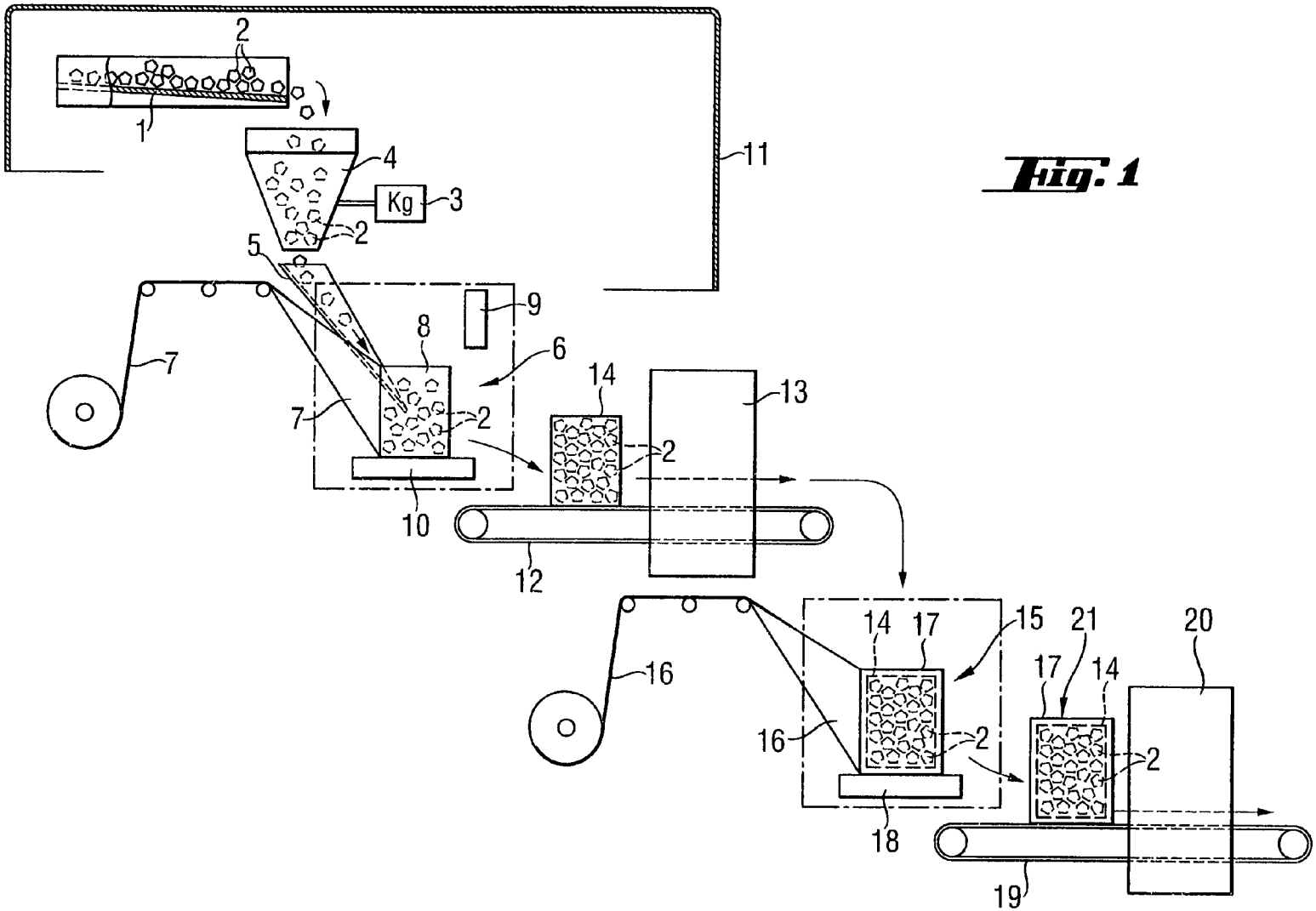
FIG. 1 illustrates a particularly preferred embodiment of the invention.

Turning now in detail to the drawings, FIG. 1 shows an apparatus according to the invention which comprises

- a conveyor channel 1 for the polysilicon fragments 2,
- a weighing device 3 for the polysilicon fragments 2, with a hopper 4,
- deflection plates 5,
- a first filling device 6, which forms a first plastic bag 8 from a highly pure plastic film 7,
- a first welding device 10 for the first plastic bag 8 filled with polysilicon fragments,
- a flowbox 11 which is fitted above the conveyor channel 1, weighing device 3, first filling device 6 and first welding device 10 and which prevents contamination of the polysilicon fragments 2 by particles,
- a first conveyor belt 12 for the welded plastic bag 14 filled with polysilicon fragments, all the components which come into contact with the polysilicon fragments 2 being sheathed with silicon or clad with a highly wear-resistant plastic.

The apparatus according to the invention preferably comprises, after the conveyor belt 12, a second filling device 15, which forms a second plastic bag 17 from a highly pure plastic film 16, a second welding device 18 for this second plastic bag 17 after it has been filled with the welded plastic bag 14 filled with polysilicon fragments, and a second conveyor belt 19 for the polysilicon fragments 2 in a double-bag pack 21.

The first filling device 6 preferably comprises a deionizer 9 which prevents electrostatic charging and therefore contamination of the plastic film 7 with particles.

The conveyor belt 12 and/or the conveyor belt 19 preferably runs through a magnetically inductive detector 13 and 20, respectively.

The plastic film 7 or 16 is preferably a PE film. The plastic film preferably has a thickness of >200 $\mu$m, particularly preferably a thickness of 290 to 350 $\mu$m.

The highly wear-resistant plastic is preferably polyurethane.

The apparatus according to the invention permits low-contamination packaging without human contact. In addition, it permits a constant quality of the packaged product.

The particular problems associated with polysilicon fragments as a material to be packaged, such as freedom from contamination, recomminution, development of dust, are solved by the aforementioned embodiments in the apparatus according to the invention. These embodiments include silicon sheathing, deionizing the air, low ejection heights as a result of the structure, or extraction means, or metal detectors.

A practical method for the operation of the apparatus and the process according to the invention will be explained by reference to the structure according to FIG. 1.

The polysilicon fragments 2 are transported into a weighing device 3 on a silicon-sheathed conveyor channel 1. The weighing device controls the filling level of a hopper 4 with polysilicon fragments 2. The polysilicon fragments 2 are emptied from the hopper 4 into a first plastic bag 8 when there is a predefined filling quantity of polysilicon fragments 2 in the hopper 4. The drop height of the silicon is minimized by deflection plates 5 adjacent to the hopper, so that undesired recomminution of the silicon does not take place. The first plastic bag 8, after being filled, is welded by means of a first welding device 10. The welded plastic bag 14 obtained in this way and filled with polysilicon fragments is conveyed by a first conveyor belt 12 through a magnetically inductive detector 13 in order to detect possible metal contamination.

In the first filling device 6, the plastic film 7 is preferably formed into a first plastic bag 8 by the film 7 being drawn over a shoulder, as it is known. In order not to contaminate the surface of the film, the shoulder is again designed from highly wear-resistant plastic. The adjacent ends of the plastic film formed into a tube are welded, the tube is welded closed at the bottom by means of a welding device. Thus a highly pure plastic bag that can be filled from the top is present and, when being filled with the polysilicon fragments, is preferably lengthened by further continuous welding of the plastic film forming a tube.

After the bag has been filled, two mold jaws preferably weld the plastic bag.

The single bag is preferably packaged in a further plastic bag. This is carried out by a second plastic bag being produced in a manner analogous to the first plastic bag. The single bag is introduced into the second bag and welded. A mechanical-pneumatic product brake preferably brakes the fall of the first plastic bag as it is introduced into the second plastic bag.

The polysilicon fragments packaged in this way can again be conveyed through a magnetically inductive detector by conveyor belt, in order to detect possible metal contamination.

Accordingly, while a few embodiments of the present invention have been shown and described, it is to be understood that many changes and modifications may be made thereunto without departing from the spirit and scope of the invention as defined in the appended claims.

What is claimed is:

1. A process for the low-contamination packaging of polysilicon fragments, comprising transporting polysilicon fragments (2) into a weighing device (3) on a silicon-sheathed conveyor channel (1), said weighing device controlling the filling level of a hopper (4) with polysilicon fragments (2);

emptying the polysilicon fragments (2) from the hopper (4) into a first plastic bag (8) when there is a predefined filling cluantity of polysilicon fragments (2) in the hopper (4);

minimizing a drop height of the silicon by deflection plates (5), so that undesired crushing of the silicon does not take place;

welding the first plastic bag (8), after being filled, by means of a first welding device (10);

conveying a plastic bag (14) obtained in this way and filled with polysilicon fragments as a single bag by first conveyor belts (12) through a magnetically inductive detector (13) in order to detect possible metal contamination; and packaging the first bag in a second plastic bag by introducing the first plastic bag into the second plastic bag and welding the second plastic bag.

* * * * *